US007513639B2

(12) United States Patent
Wang

(10) Patent No.: US 7,513,639 B2
(45) Date of Patent: Apr. 7, 2009

(54) LED ILLUMINATION APPARATUS

(75) Inventor: Pei-Choa Wang, Gueishan Township, Taoyuan County (TW)

(73) Assignee: Pyroswift Holding Co., Limited, Wanchai (HK)

( * ) Notice: Subject to any disclaimer, the term of this patent is extended or adjusted under 35 U.S.C. 154(b) by 0 days.

(21) Appl. No.: 11/537,554

(22) Filed: Sep. 29, 2006

(65) Prior Publication Data

US 2008/0080189 A1 Apr. 3, 2008

(51) Int. Cl.
*F21V 7/20* (2006.01)

(52) U.S. Cl. ..... 362/218; 362/294; 362/373; 362/800

(58) Field of Classification Search ..... 362/218, 362/800, 297, 249, 237, 373
See application file for complete search history.

(56) References Cited

U.S. PATENT DOCUMENTS 7,165,863 B1 * 1/2007 Thomas et al. ..... 362/219
7,261,435 B2 * 8/2007 Gould et al. ..... 362/223
7,298,969 B2 * 11/2007 Elberbaum ..... 396/28
2003/0058650 A1 * 3/2003 Shih ..... 362/294
2004/0120152 A1 * 6/2004 Bolta et al. ..... 362/294
2007/0109777 A1 * 5/2007 Zhang et al. ..... 362/218
2008/0089071 A1 * 4/2008 Wang ..... 362/294

FOREIGN PATENT DOCUMENTS

TW M292042 6/2006

* cited by examiner

*Primary Examiner*—Sandra L O'Shea
*Assistant Examiner*—Jessica L McMillan

(57) ABSTRACT

An LED illumination apparatus includes a lamp housing, an LED module, distal covers and a light-transmitting hood. The lamp housing has a base, a heat sink at the top of the base, a heat dissipating channel between two adjacent heat sinks, and a receiving portion on an internal side of the base. The LED module includes a fixing base, a lampshade on a side of the fixing base, a plurality of LED lamps in the lampshade, and a connecting portion on the fixing base and coupled to the corresponding receiving portion. Each distal cover seals the front and back of the lamp housing, and the light-transmitting hood is connected under the lamp housing, and a containing space enclosed by the lamp housing, distal cover and light-transmitting hood for installing the LED module. The invention can simplify the manufacturing processes and reduce the material cost and development time.

9 Claims, 6 Drawing Sheets

LED ILLUMINATION APPARATUS

BACKGROUND OF THE INVENTION

1. Field of the Invention

The present invention relates to an LED illumination apparatus, and more particularly to an LED illumination apparatus that can simplify the processes of manufacturing and assembling lamps.

2. Description of Prior Art

Since light emitting diodes (LEDs) feature the advantages of high brightness, power saving and long life expectancy, LEDs have been used extensively for illuminations. Several LED lamps are usually arranged and connected to a circuit board to form an LED lamp module and several LED lamp modules are connected in series or in parallel to constitute an LED module to achieve an illumination effect that meets the requirements for a large projecting area and a high brightness for outdoor illuminations, and serve as an indoor or outdoor illumination apparatus. The outdoor illumination apparatus is usually exposed to the outside over a long period of time, and thus its requirements for air tightness, water resistance, dust resistance, and heat dissipation are higher than those of the indoor illumination apparatuses. Further, the LED lamps come with a low heat resistance, and thus a heat sink is usually required for dissipating the heat produced by each LED lamp. Therefore, it is an important subject for manufacturers in the related field to find an effective feasible solution to solve the foregoing problems.

A traditional LED illumination apparatus as disclosed in R.O.C. Pat. No. M292042 includes a lamp housing, a light-transmitting hood, a partition and an LED module, wherein the lamp housing includes a ventilation channel, and the light-transmitting hood is connected to the lamp housing, and the partition is connected horizontally between the lamp housing and the light-transmitting hood for isolating a first space and a second space, and the partition has an opening at its center, and the LED module includes a circuit board, a heat sink mounted separately on both upper and lower flat surfaces of the circuit board and a plurality of LED lamps, and the circuit board is installed at the opening of the partition, and all LED lamps are contained in the second space, and the heat sinks are contained in the first space and composed of a heat pipe and a plurality of heat sinks coupled to the heat pipe, and the heat sinks are stacked with each other, so that the foregoing components constitute an LED illumination apparatus.

However, the traditional LED illumination apparatus still has the following drawbacks on its usage. Since the lamp housing, the partition and the heat sink of the LED module are made separately, not only incurring a high cost for preparing different molds for different components, but also requiring a relatively complicated manufacturing process and greatly increasing the manufacturing and assembling costs. Further, it is necessary to produce different molds for different models of illumination apparatuses according to their specifications, powers or lumens, and thus further increasing the cost for making molds and extending the time for developing and manufacturing the lamps. The traditional LED illumination apparatus only uses heat pipes for heat dissipation, but the heat pipe has a very limited surface area in contact with the LED lamp, and thus the quantity of dissipated heat is also limited. Obviously, the prior art requires further improvements.

SUMMARY OF THE INVENTION

In view of the foregoing shortcomings of the prior art, the inventor of the present invention based on years of experience in the related industry to conduct experiments and modifications, and finally designed an LED lamination apparatus in accordance with the present invention.

Therefore, the present invention is to provide an LED illumination apparatus that is extruded integrally with a lamp housing by an aluminum material to simplify the processes of manufacturing and assembling the lamp. Furthermore, it is not necessary to produce different molds for different models of the illumination apparatuses according to their specifications, powers or lumens, and thus effectively lowering the cost for making molds and shortening the time for developing and manufacturing the lamps, since the lamp housing can be cut and divided according to actual needs.

The present invention provides an LED illumination apparatus that comprises an aluminum extrusion lamp housing, a plurality of LED modules, a set of distal covers and a light-transmitting hood, wherein the lamp housing has a base, a plurality of heat sinks extended upward from the top of the base, a heat dissipating channel formed between any two adjacent heat sinks, and a receiving portion formed on an internal side of the base. The LED module comprises a fixing base, a lampshade fixed onto a lateral side of the fixing base, a plurality of LED lamps disposed in the lampshade, and a connecting portion disposed on the fixing base and coupled to the corresponding receiving portion of the base. Each distal cover seals and connects both front and back sides of the lamp housing, and the light-transmitting hood is connected to the bottom of the lamp housing, and a containing space is enclosed by the lamp housing, distal cover and light-transmitting hood for installing the LED module therein.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
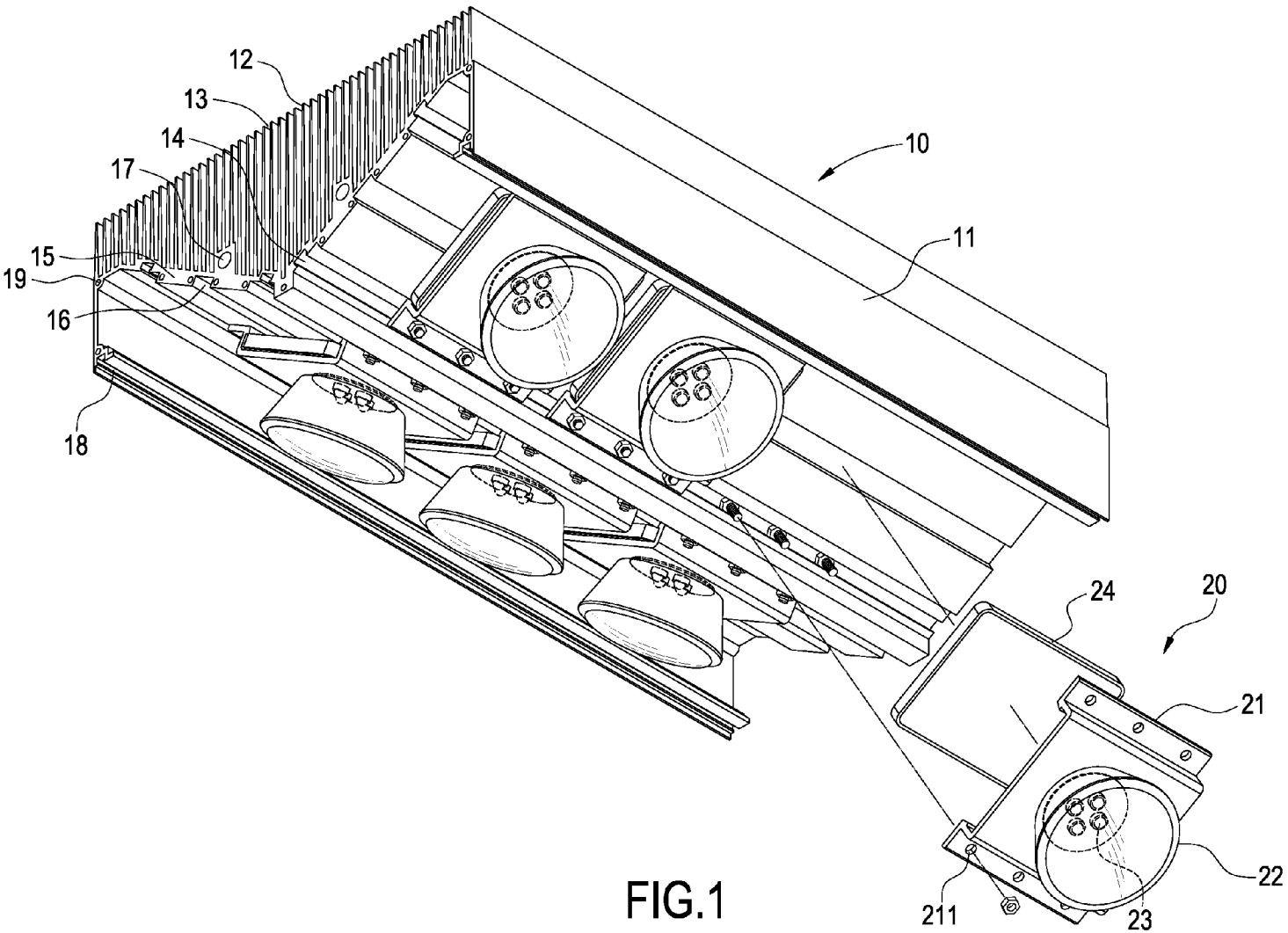
FIG. 1 is a partial exploded view of a lamp housing and an LED module in accordance with the present invention.
Figure 2:
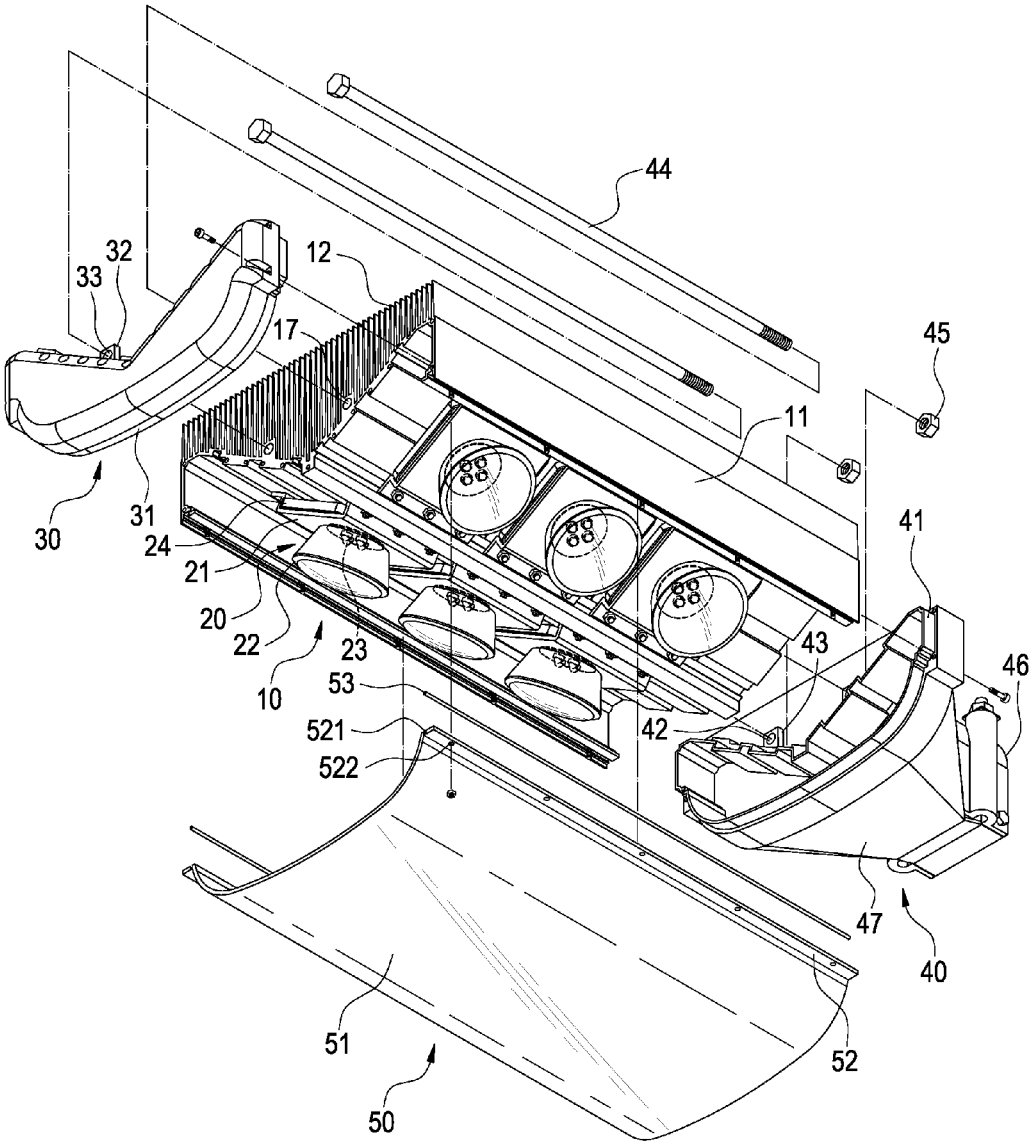
FIG. 2 is an exploded view of the present invention.
Figure 3:
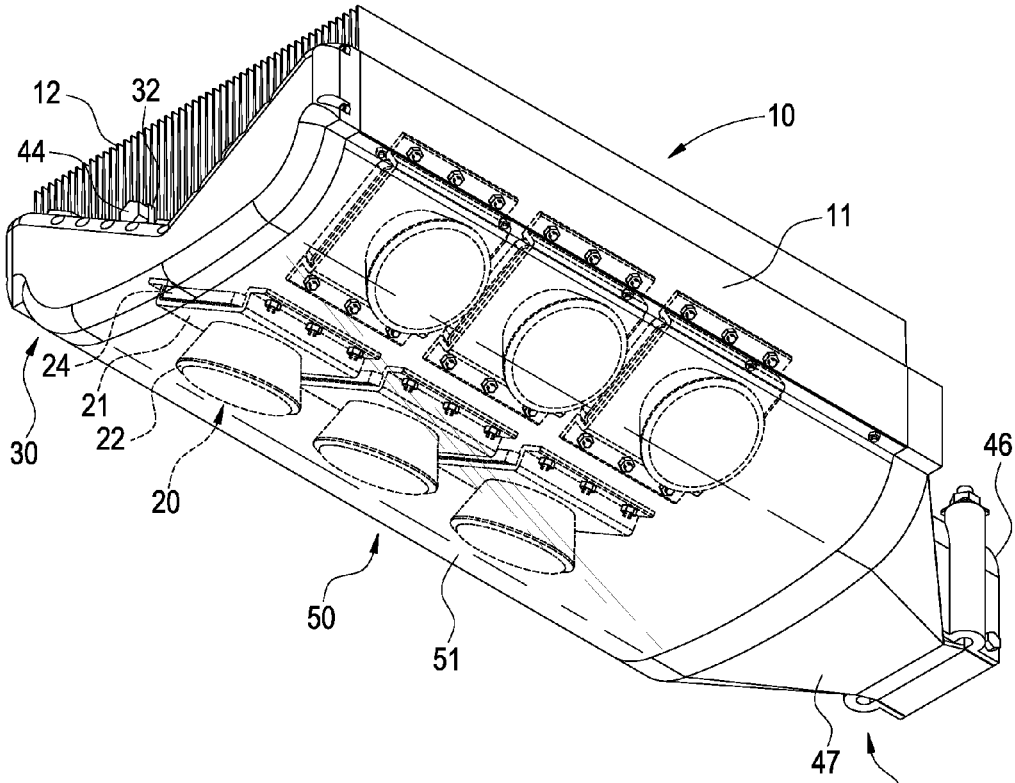
FIG. 3 is a schematic perspective view of the present invention.
Figure 4:
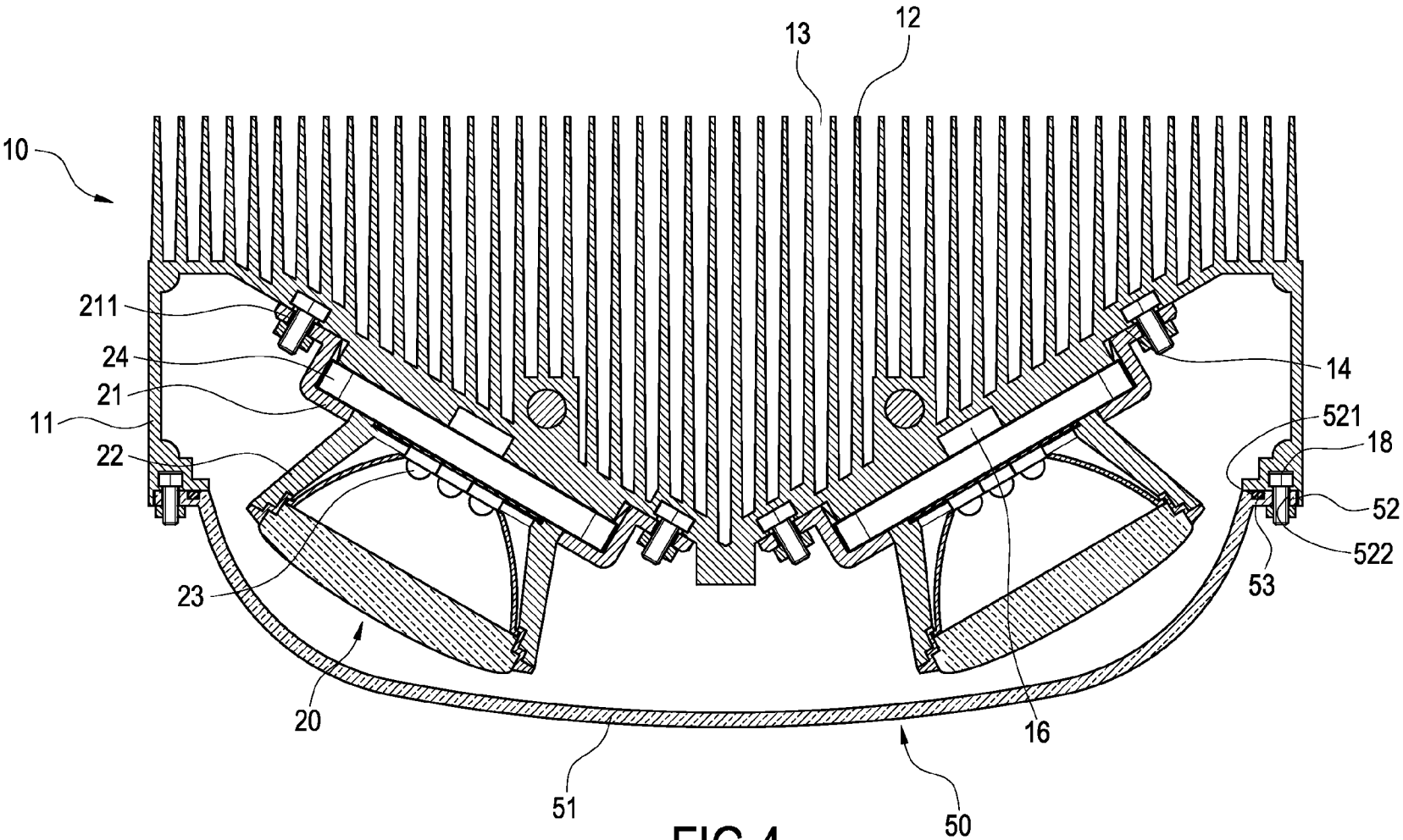
FIG. 4 is a cross-sectional view of the present invention.

The technical characteristics, features and advantages of the present invention will become apparent in the following detailed description of the preferred embodiments with reference to the accompanying drawings. However, the drawings are provided for reference and illustration only and are not intended for limiting the scope of the invention.

Referring to FIGS. 1 to 4 for a partial exploded view, an exploded view, a perspective view and a cross-sectional view of a lamp housing and an LED module in accordance with the present invention, an LED illumination apparatus of the invention comprises an aluminum extrusion lamp housing 10, a plurality of LED modules 20, a set of distal covers 30, 40 and a light-transmitting hood 50.

The aluminum extrusion lamp housing 10 comprises an M-shape base 11, a plurality of parallel heat sinks 12 extended upward from the top of an oblique plate of the base 11, a heat dissipating channel 13 formed between any two adjacent heat sinks 12, a plurality of parallel receiving portions 14 formed at the bottom of the oblique plate of the base 11, and the receiving portion 14 of this embodiment is a T-shape groove for embedding and fixing the head of a screw bolt, a protrusion 15 extended downward from an interval between the receiving portions 14, and a wire containing slot 16 disposed at the middle of the protrusion 15. The LED illumination apparatus further comprises two corresponding penetrating holes 17 disposed at the middle of the top of the oblique plate of the base 11, a channel 18 disposed separately on both left and right sideboards of the base 11, and a plurality of screw holes 19 disposed on both front and rear distal surfaces.

The LED module 20 comprises a flat U-shape fixing base 21, a lampshade 22 mounted onto an external side of the fixing base 21 and a plurality of LED lamps 23 installed in the lampshade 22. The fixing base 21 includes a connecting portion 211 corresponding to the receiving portion 14, and the connecting portion 211 of this embodiment is disposed at a through hole of the fixing base 21 for passing and fixing a screw bolt and being coupled by a screw nut. The LED module 20 further comprises a heat equalizer 24 fixed in the fixing base 21 and having its upper and lower flat surfaces attached onto the protrusion 15 and the backside of each LED lamp 23 respectively, and a thermal grease (not shown in the figure) coated onto a contact surface between the bottom of the protrusion 15 and the heat equalizer 24 for improving its thermal conduction efficiency.

Each distal cover 30, 40 separately seals and connects the front and back sides of the lamp housing 10, and the front distal cover 30 has an extending section 31 disposed on an internal side of the front distal cover 30 and connected with the base 11. The front distal cover 30 forms a protruding ear 32 thereon, and a through hole 33 disposed on the protruding ear 32 and corresponding to the penetrating hole 17. The rear distal cover 40 has an extending section 41 disposed on an internal side of the rear distal cover 40 and connected with the base 11. The rear distal cover 40 forms a protruding ear 42 thereon, and a through hole 43 disposed on the protruding ear 42 and corresponding to the penetrating hole 17 for passing and fixing a screw bolt 44 and a screw nut 45. Further, the rear distal cover 40 has a fixing hole 46 formed at the rear of the rear distal cover 40 and a movable protecting cover 47 disposed under the rear distal cover 40, and the protecting cover 47 can be turned downward to facilitate the connection of a power cable (as shown in FIG. 5).

The light-transmitting hood 50 is connected to the bottom of the lamp housing 10, and a containing space is enclosed by the lamp housing 10, the distal covers 30, 40 and the light-transmitting hood 50 for installing the LED modules 20. The light-transmitting hood 50 could be made of a transparent or semi-transparent material and comprises a curved board 51, two flat boards 52 extended horizontally outward from the distal ends of the curved board 51, and a groove 521 and a through hole 522 formed on each flat board 52 respectively. The groove 521 is provided for installing a rectangular waterproof rubber strip 53 to prevent external moisture from permeating into the interior, and the through hole 522 is installed correspondingly with the channel 18 of the base 11 for passing and fixing a screw bolt and a screw nut.

In the installation of the LED illuminating apparatus, the heads of a plurality of screw bolts are embedded into the receiving portion 14 of the lamp housing 10, and their screw threads are protruded outwardly to the outside, and the connecting portion 211 of each fixing base 21 is connected correspondingly to each screw thread, and then a screw nut is screwed to a screw thread to fix the LED module 20 into the lamp housing 10, such that the top surface of the heat equalizer 24 is attached onto the bottom surface of the protrusion 15 of the lamp housing 10, and the conducting wire (not shown in the figure) of each LED module 20 is contained in the wire containing slot 16; and a glue is applied on the surfaces of the extending sections 31, 41 of each distal cover 30, 40 for embedding and fixing with the front and rear of the base 11. After the screw bolt 44 is passed sequentially through the through hole 33 of the distal cover 30, the penetrating hole 17 of the lamp housing 10 and the through hole 43 of the distal cover 40, the screw nut 45 is used for fixing the screw bolt 44. Finally, a waterproof rubber strip 53 is installed into the groove 521 of the light-transmitting hood 50, and the flat board 52 of the light-transmitting hood 50 is attached onto the channel 18 of the lamp housing 10 and fixed by the screw nut, so as to constitute an LED illumination apparatus.

Figure 5:
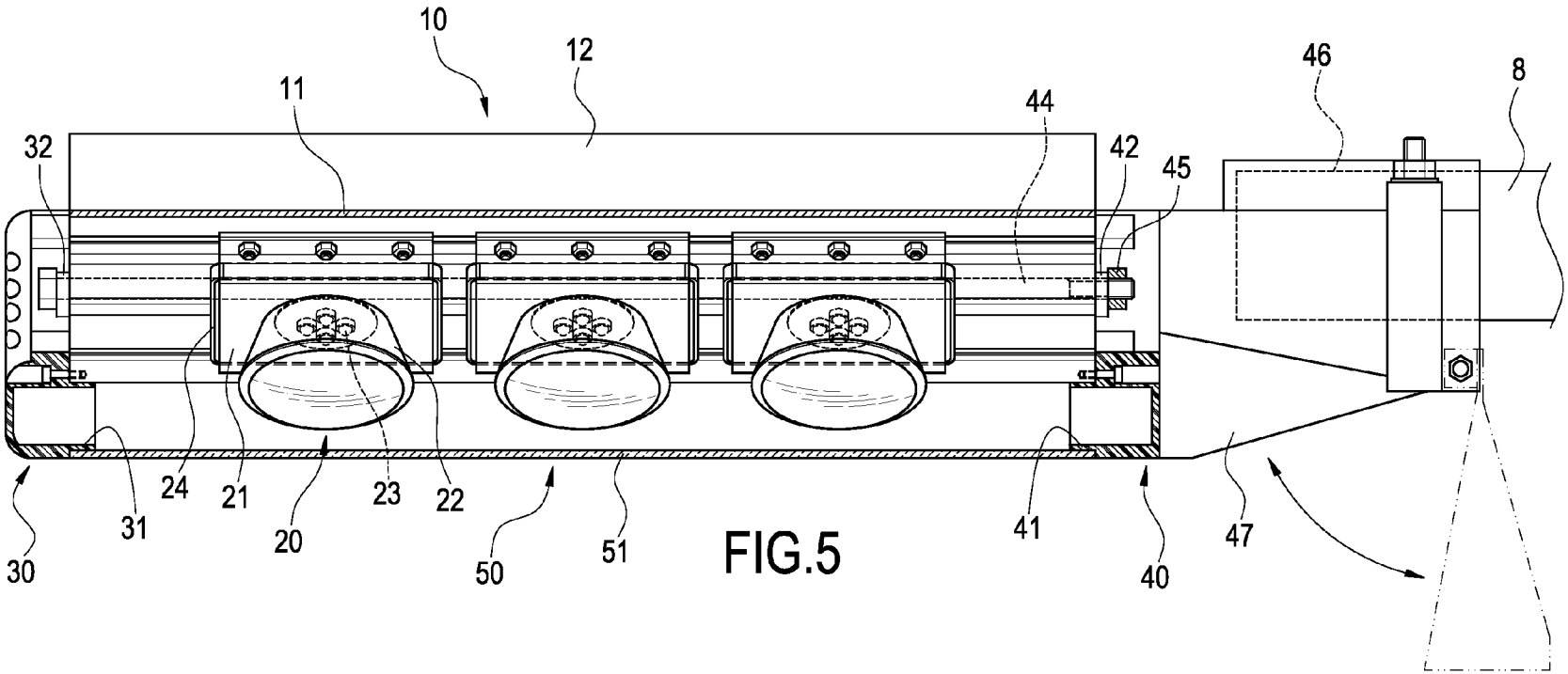
FIG. 5 is a cross-sectional view of an illumination apparatus applied to a road lamp in accordance with a preferred embodiment of the present invention.

Referring to FIG. 5 for a cross-sectional view of an LED illumination apparatus being applied to a road lamp in accordance with a preferred embodiment of the present invention, the fixing hole 46 of the distal cover 40 is sheathed onto a distal end of a lamp rod 8 when the road lamp is used, and then the protecting cover 47 of the distal cover 40 is provided for connecting the power cables inside the lamp rod 8 with the conducting wire of each LED module 20. If an electric current is passed through each LED lamp 23, each LED lamp 23 will emit light and produce heat, and the heat will be dissipated quickly to the top surface of the heat equalizer 24 and conducted to the heat sinks 12 of the lamp housing 10 through a large contact area of the heat equalizer 24 and the fluid-phase thermal conduction mechanism, such that each LED lamp 23 can emit light at a lower temperature, and thus extending the life expectancy of the LED lamps.

Figure 6:
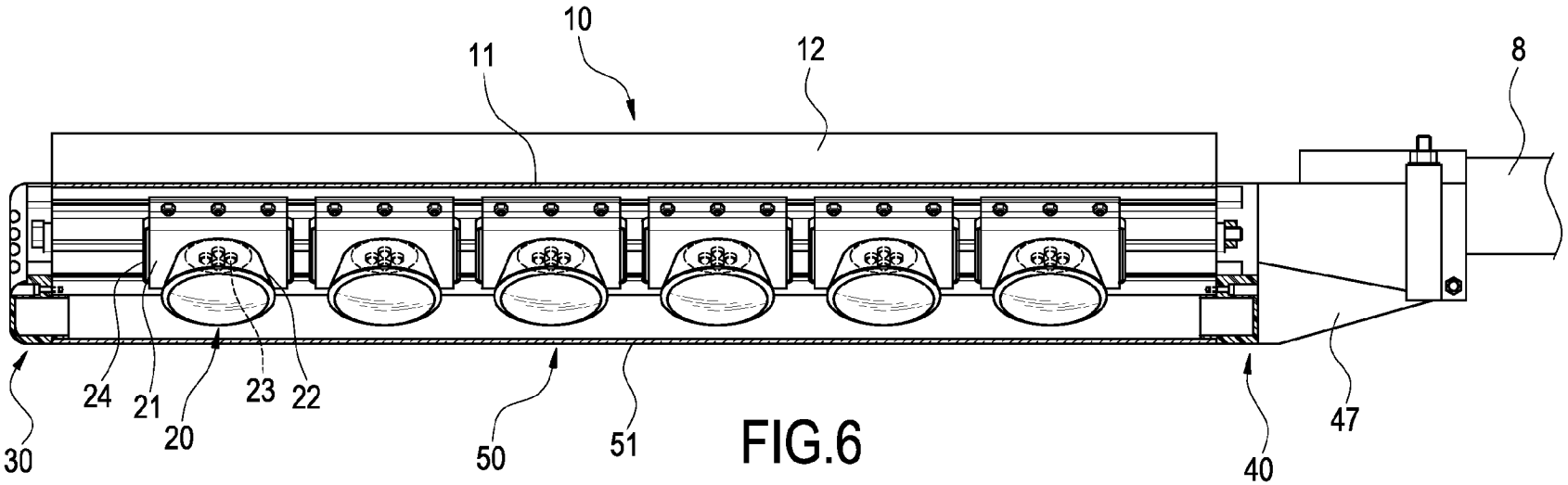
FIG. 6 is a cross-sectional view of an illumination apparatus applied to a road lamp in accordance with another preferred embodiment of the present invention.

Referring to FIG. 6 for a cross-sectional view of an LED illumination apparatus being applied to a road lamp in accordance with another preferred embodiment of the present invention, the lamp housing 10 of the invention is formed integrally by aluminum extrusion, and the extruded length can be up to tens of centimeters, such that the lamp housing 10 can be cut and divided according to different specifications, powers or lumens and requirements of the illumination apparatuses. Therefore, it is not necessary to make new molds again for different lamp housings, and the invention can effectively lower the cost of molds and shorten the development time. Furthermore, the base 11, the heat sink 12 and the receiving portion 14 are produced in the same manufacturing process, so as to greatly simply the processes of manufacturing and assembling the lamps and lower costs.

In summation of the description above, the LED illumination apparatus of the invention complies with the patent application requirements and is duly filed for patent application.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An LED illumination apparatus, comprising:

an aluminum extrusion lamp housing, having a base, a plurality of heat fins extended upward from the top surface of the base, a heat dissipating channel disposed between any two adjacent heat fins, and a receiving portion formed on the bottom surface of the base;

a plurality of LED modules, each having a fixing base, a lampshade mounted onto a side of the fixing base, a plurality of LED lamps installed in the lampshade, and a connecting portion disposed on the fixing base for the LED module being coupled to the base through the receiving portion;

a pair of distal covers, for merely sealing and connecting both front and back sides of the base of the lamp housing respectively, the heat fins being exposed for heat dissipation;

a light-transmitting hood, coupled to the bottom of the lamp housing, so that a containing space is enclosed by the lamp housing, the distal covers and the light-transmitting hood for installing the LED modules, wherein the receiving portion is formed as a T-shaped groove on an oblique board of the base for a screw bolt being slid therein, and the connecting portion has a through hole for the screw bolt passing through and a screw nut being engaged with the screw bolt to fix the LED modules on the base; and a protrusion extended downward from an interval between two receiving portions, and a wire containing slot disposed at the middle of the protrusion.

2. The LED illumination apparatus of claim 1, wherein the base of the lamp housing is substantially in an M-shape.

3. The LED illumination apparatus of claim 2, wherein the base includes a channel disposed at the bottom of a sideboard of the base, and the light-transmitting hood includes two flat boards, and a groove and a through hole formed on each flat board respectively, and the groove is provided for installing a rectangular waterproof rubber strip, and the through hole is installed correspondingly with the channel, for passing and fixing a screw bolt and a screw nut.

4. The LED illumination apparatus of claim 1, wherein the LED module further comprises a heat equalizer attached separately onto both upper and lower flat surfaces of the protrusion of the lamp housing and each LED lamp.

5. The LED illumination apparatus of claim 1, wherein the base includes two corresponding penetrating holes disposed on the top of the base, and each distal cover forms a protruding ear, and the protruding ear has a through hole disposed thereon and corresponding to the penetrating hole, for passing and fixing a screw bolt and a screw nut.

6. The LED illumination apparatus of claim 1, wherein each distal cover has an extending section protruded inwardly and to be inserted into the base.

7. The LED illumination apparatus of claim 1, wherein the rear distal cover has a movable protecting cover disposed under the rear distal cover.

8. The LED illumination apparatus of claim 1, wherein the light-transmitting hood is transparent or semi-transparent.

9. An LED illumination apparatus, comprising:

an aluminum extrusion lamp housing, having a base with a substantial M-shape in cross section, a plurality of heat sinks extended from the top of the base, a heat dissipating channel disposed between any two adjacent heat sinks, and a receiving portion formed on an internal side of the base;

a protrusion extended downward from an interval between the receiving portions, and a wire containing slot disposed at the middle of the protrusion;

a plurality of LED modules, each having a fixing base, a lampshade mounted onto a side of the fixing base, a plurality of LED lamps installed in the lampshade, and a connecting portion disposed on the fixing base and coupled to the corresponding receiving portion of the base, wherein the LED module further comprises a heat equalizer attached separately onto both upper and lower flat surfaces of the protrusion of the lamp housing and each LED lamp;

a set of distal covers, for sealing and connecting both front and back sides of the lamp housing respectively; and a transparent or semi-transparent light-transmitting hood, coupled to the bottom of the lamp housing, and having a containing space enclosed by the lamp housing, the distal covers and the light-transmitting hood for installing the LED modules, wherein the rear distal cover has a movable protecting cover disposed under the rear distal cover, wherein the receiving portion is formed at a T-shape groove of an oblique board of the base, and the connecting portion is disposed at a through hole of the fixing base for passing and fixing a screw bolt and a screw nut, wherein the base includes a channel disposed at the bottom of a sideboard of the base and the light-transmitting hood includes two flat boards, and a groove and a through hole formed on each flat board respectively, and the groove is provided for installing a rectangular waterproof rubber strip, and the through hole is installed correspondingly with the channel for passing and fixing a screw bolt and a screw nut, wherein the base includes two corresponding penetrating holes disposed on the top of the base, and each distal cover forms a protruding ear, and the protruding ear has a through hole disposed thereon and corresponding to the penetrating hole, for passing and fixing a screw bolt and a screw nut, and wherein each distal cover has an extending section protruded inwardly and to be inserted into the base.

* * * * *